US009813805B2

(12) United States Patent
Chapman et al.

(10) Patent No.: US 9,813,805 B2
(45) Date of Patent: Nov. 7, 2017

(54) APPARATUS FOR REDISTRIBUTING ACOUSTIC ENERGY

(71) Applicant: Bang & Olufsen A/S, Struer (DK)

(72) Inventors: Peter John Chapman, Lemvig (DK); Martin Olsen, Struer (DK)

(73) Assignee: BANG & OLUFSEN A/S, Struer (DK)

( * ) Notice: Subject to any disclaimer, the term of this patent is extended or adjusted under 35 U.S.C. 154(b) by 0 days.

(21) Appl. No.: 15/026,078

(22) PCT Filed: Oct. 16, 2014

(86) PCT No.: PCT/EP2014/072211
§ 371 (c)(1),
(2) Date: Mar. 30, 2016

(87) PCT Pub. No.: WO2015/055763
PCT Pub. Date: Apr. 23, 2015

(65) Prior Publication Data

US 2016/0219366 A1 Jul. 28, 2016

(30) Foreign Application Priority Data

Oct. 16, 2013 (DK) ..... 2013 70588

(51) Int. Cl.

| | |
|---|---|
| ***H04R 1/20*** | (2006.01) |
| ***H04R 1/34*** | (2006.01) |
| ***G10K 11/28*** | (2006.01) |
| ***G10K 11/20*** | (2006.01) |

(52) U.S. Cl.
CPC ..... *H04R 1/345* (2013.01); *G10K 11/20* (2013.01); *G10K 11/28* (2013.01)

(58) Field of Classification Search
CPC ..... H04R 1/30; H04R 1/323; H04R 1/345
See application file for complete search history.

(56) References Cited

U.S. PATENT DOCUMENTS 2,643,727 A * 6/1953 Leon ..... H04R 1/345 181/155
4,580,655 A * 4/1986 Keele, Jr. ..... H04R 1/345 181/187

(Continued)

FOREIGN PATENT DOCUMENTS

GB 830745 A 3/1960
WO WO-9956512 A1 11/1999

OTHER PUBLICATIONS

Danish Search Report for Application No. PA201370588 dated May 15, 2014.

(Continued)

*Primary Examiner* — Curtis Kuntz
*Assistant Examiner* — Ryan Robinson
(74) *Attorney, Agent, or Firm* — Harness, Dickey & Pierce, PLC

(57) ABSTRACT

An apparatus for re-distributing acoustic energy. The apparatus comprises a first concave surface defined as a surface of revolution of a line or curve. This curve of revolution is rotated beyond 230 degrees and thus defines a rather small opening, which has advantages in the frequency response output. Additionally or alternatively, edges of the concave surface may be rounded to provide advantageous effects in the sound output.

18 Claims, 4 Drawing Sheets

(56) References Cited

U.S. PATENT DOCUMENTS

Figure 1:
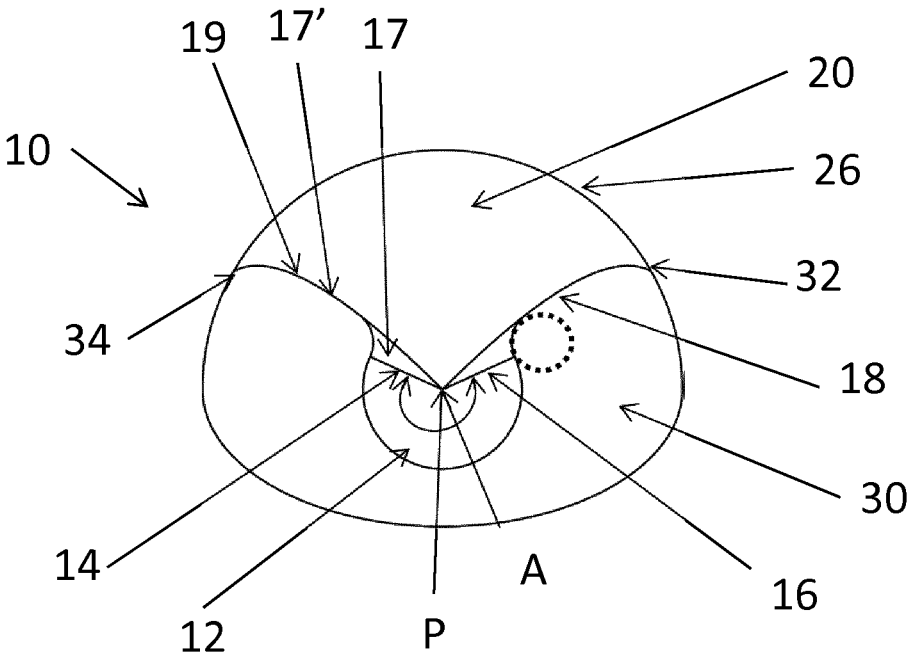

| | | | | |
|---|---|---|---|---|
| 4,836,328 | A * | 6/1989 | Ferralli | H04R 1/345 181/155 |
| 4,836,329 | A | 6/1989 | Klayman | |
| 5,402,502 | A * | 3/1995 | Boothroyd | H04R 1/026 181/153 |
| 5,615,176 | A * | 3/1997 | LaCarrubba | H04R 1/34 367/151 |
| 6,068,080 | A * | 5/2000 | LaCarrubba | H04R 1/34 181/155 |
| 6,435,301 | B1 | 8/2002 | LaCarrubba | |
| 6,820,718 | B2 * | 11/2004 | LaCarrubba | H04R 1/345 181/155 |
| 2004/0065500 | A1 | 4/2004 | LaCarrubba | |
| 2005/0207593 | A1 | 9/2005 | Praestgaard et al. | |
| 2006/0147076 | A1 * | 7/2006 | Hoffmann | H04R 1/345 381/337 |

OTHER PUBLICATIONS

International Search Report PCT/ISA/210 for International Application No. PCT/EP2014/072211 dated Mar. 27, 2015.

Written Opinion of the International Searching Authority PCT/ISA/237 for International Application No. PCT/EP2014/072211 dated Mar. 27, 2015.

* cited by examiner

APPARATUS FOR REDISTRIBUTING ACOUSTIC ENERGY

CROSS-REFERENCE TO RELATED APPLICATIONS

This application is a national phase under 35 U.S.C. §371 of PCT International Application No. PCT/EP2014/072211 which has an International filing date of Oct. 16, 2014, which claims priority to Denmark Application No. PA 2013 70588, filed Oct. 16, 2013, the entire contents of each of which are hereby incorporated by reference.

The present invention relates to an apparatus for redistributing acoustic energy, such as an acoustic lens, which is configured to receive and distribute acoustic energy, such as sound.

An acoustic lens may be seen in e.g. U.S. Pat. No. 5,615,176, U.S. Pat. No. 6,068,080 and U.S. Pat. No. 6,435,301.

In a first aspect, the invention relates to an apparatus for redistributing acoustic energy, the apparatus comprising a surface with:

- a first part having a shape of a first surface of revolution, within a first angular interval from a first angular position to a second angular position and around an axis, of a first line extending through a point, P, on the axis,
- a second part having a shape of a second surface of revolution, within a second angular interval from a fifth angular position to a sixth angular position and around the axis, of a second line extending through the point P, the first part being defined at longitudinal positions, along the axis, on one side of the point P and the second part being defined at longitudinal positions on an opposite side of the point P,
- a back surface extending, within a third angular interval from a third angular position to a fourth angular position and around the axis, the back surface being positioned further away from the axis than the first part, wherein the first angular interval exceeds 230°.

In this context, the apparatus may be formed of a single, monolithic element, or may be formed by a number of elements or parts attached to each other. The apparatus may be made of a plastic/rubber/polymer material, a metal, an alloy, or the like. The apparatus, such as the first part thereof and/or other surfaces thereof, may be provided with a surface configured for sound reflection, such as a metal/alloy surface or a hard surface.

The redistribution of acoustic energy may be obtained by the acoustic energy, such as sound, impinging on the surface of the apparatus and being reflected therefrom. The spatial distribution of the acoustic energy impinging on the apparatus and that output or reflected therefrom may be different or identical if desired.

The surface of the apparatus usually will be an outer surface or a part of an outer surface of the apparatus.

The first part is shaped as a surface of revolution of the first line which may have any shape. Usually, the first line will be curved, such as curved in a manner so that it is defined in a single, flat or straight, plane, such as a plane in which the axis is also present.

The surface of revolution is obtained by rotating the first line from the first angular position to the second angular position. The absolute values of the first and second angular positions are not important. The difference there between defines the extent of the first surface around the axis. A curvature of the first line, which may be straight but preferably is curved, may be selected according to the desired redistribution of the acoustic energy. In the prior art lenses, the first line forms part of an ellipse or is parabolic. Other curve shapes, such as a part of a circle, a hyperbola or the like may, however, also be used, as may a smooth spline between the two extreme points, where smooth may be defined as a curve, the change of gradient of which is without discontinuities.

The shape of the first part may be selected in accordance with an expected or desired distribution of acoustic energy directed toward the first part and a distribution of acoustic energy reflected thereby. In an idealized model, the acoustic energy to be redistributed may be seen as stemming from a point source or an element, such as a flat element, acting like a piston.

When the first line extends through the point P on the axis of rotation, the first part extends from the point P at least in one direction, when projected on to the axis, from the point P and along the axis. Naturally, the first line may extend through the point P and extend in two directions from the point P so that the first part extends, when projected on to the axis, on both sides of the point P. A surface of this type may be seen in U.S. Pat. No. 5,615,176.

Preferably, the line extends, at the first part, so that a distance between the line and the axis increases with the distance to the point P, such as the distance perpendicularly to the axis.

Also, preferably, the line is unbroken, continuous and/or smooth. In one embodiment, a derivative, or rate of change of gradient, of the line is without discontinuities.

The angular positions may be determined in relation to the axis and a defined zero angle in relation thereto. The angular position of the line may be that of a plane wherein the line is defined. Additionally or alternatively, the angular position may be an angular position of a predetermined part or point of or on the line.

The first part extends from the first angular position to the second angular position. In a preferred embodiment, the extreme portions of the first part, in all planes perpendicular to the axis and wherein part of the first part exists, extend to the first and second angular positions, so that the outer parts thereof are defined by the shape of the line. Alternatively, the first part extends to, in part of the planes, other angular positions positioned within the first angular interval. The extreme portions of the first part, along the direction of rotation around the axis, will be denoted a first and a second border.

Additionally, the extreme portions of the first part, in the directions along the axis, may be defined as a part of a circle having the same longitudinal position along the axis, or part of the extreme portions of the first part may be positioned at longitudinal positions closer to the point P than others.

Preferably, the first part defines a cavity into the apparatus and around the axis. Then, as will be described below, the acoustic energy may be fed along the axis to the first part and be redistributed by the first part.

The values of the first and second angular positions are not that relevant. These may be determined based upon target criteria in a given application requiring a given redistribution of sound energy. However, the difference between these angular positions defines the angular extent or first angular interval of the first part. This angular interval will take part in the defining of the redistribution of the acoustic energy. This angular interval preferably is in the interval of 230-330 degrees, such as 240-300 degrees, such as 230-300 degrees, such as 250-290 degrees or 230-280 degrees, preferably 240-270 degrees or 260-280 degrees, depending on the redistribution desired. Some embodiments relate to a first angular interval of 250-290 degrees such as around 270 degrees.

Naturally, this aspect may be combined with all of the below features and aspects.

A second aspect of the invention relates to an apparatus for redistributing acoustic energy, the apparatus comprising a surface with:

a first part having a shape of a first surface of revolution, within a first angular interval from a first angular position to a second angular position and around an axis, of a first line extending through a point, P, on the axis, a back surface extending, within a third angular interval from a third angular position to a fourth angular position and around the axis, the back surface being positioned further away from the axis than the first, and a first side portion extending from the first part at the first angular position and to the back surface at the third angular position, wherein:

the first side portion has, at the first angular position and at the first part, a shape approximating:

at a first longitudinal position along the axis, a part of a circle having a first radius, and at a second longitudinal position along the axis, a part of a circle having a second radius, the second longitudinal position being closer to the point P than the first longitudinal position and the second radius being smaller than the first radius.

In this aspect, the individual parts and features may be as those mentioned in relation to the first aspect. The back surface may also be defined as a surface of revolution, but this is not required. This surface may not have a large influence on the redistribution.

The back surface extends between a third and a fourth angular position and within a third angular interval. Thus, the back surface may be delimited, in the direction of rotation around the axis, at a third and a fourth angular position. As is the situation with the first part, the third and fourth angular positions may be defined by only one predefined part or point on a circumference of the back surface, or all extreme positions of the back surface, along the direction of rotation around the axis, may be at the third and fourth angular positions.

The outermost, in the direction of rotation around the axis, parts of the back surface are denoted a third and a fourth border which may be straight, such as parallel to the axis, or not.

A major part, such as at least 50%, such as at least 60%, preferably at least 80%, such as 85% of the third angular interval preferably overlaps the first angular interval. Similarly, preferably a major part, such as at least 50%, such as at least 60%, preferably at least 80%, such as 85% of the first angular interval overlaps the third angular interval. Then, when the back surface is provided farther from the axis than the first part, a part of the apparatus may be defined, such as a solid material or element, between the back surface and the first part.

Between the back surface and the first part, the first side portion is defined extending from the first part at the first angular position or the first border and to the back surface at the third angular position or the third border.

Preferably, the first and third angular positions are within 20°, such as within 10°, preferably within 5°. Thus, the side portion preferably has a main direction away from the first part and toward the back surface. However, the part the closest to the first part has the particular shape described.

The shape of the first side portion at the first angular position and at the first part (at or in the vicinity of the first border) preferably forms a smooth transition from the first area to or toward the back surface, such as a to a major part of the first side portion, such as in a plane perpendicular to the axis.

In general, sound re-radiated from sharp edges has a tendency of interfering with the sound radiating from the reflector. This interference will depend on the wavelength and quantity of sound energy propagating along a surface towards the edge and thus may generate different lobes of in-phase and out-of-phase sound at different frequencies.

When close to the point P, the cross sectional curvature of the first area, in a plane perpendicular to the axis, becomes smaller, so that a smaller curvature may be allowed, whereas farther from the point P, a larger curvature is desired.

It is noted that the approximation of the part of the side portion at the first border, the first angular position and/or close to the first part need only be an approximation. Different shapes will be acceptable, as long as the interface between the first part and the side portion is smooth. Thus, preferably, at at least the first and second longitudinal positions, and in a plane perpendicular to the axis, a derivative of the transition between the first part and the first side portion is continuous and/or without discontinuities.

In addition, the part of the circle preferably is a 1/20 of a circle (18°) or more, such as 1/10 (36°) or more, such as 1/8 or more, such as 1/5 of a circle or more. In one embodiment, the part of the circle is around 1/4 of a circle. The parts at the first and second longitudinal positions may be different or the same.

The approximation of the part of the side portion to the circle may be obtained when the part conforms to the circle for at least an angle of 20°, such as at least 40°, such as at least 75°.

In this context, "conforms" preferably means no part of the part of the side portion deviates from the circle by more than 10%, such as no more than 5% of the length of the radius of the circle, where the deviation from a point on the side portion to the circle is determined along a radius of the circle.

Preferably, the first radius is at least 2 mm, such as at least 4 mm, preferably at least 5 mm, such as at least 8 mm. The first radius may be selected to be as far from the point P as possible. Below, the lower edge of the side portion will be described, and the first radius may be at this lower edge. Additionally or alternatively, the first radius may be the largest radius of the apparatus, i.e. at a longitudinal position where this radius is the largest.

In a preferred embodiment, the size of the radius is a linear function of the longitudinal position, where the radius at the point P may be selected to be zero or close to zero. Other relations may also be used, as long as the radius drops toward the point P. Even though a stepped function or relation may be used, it is preferred that the radius drops smoothly and without abrupt changes.

In one situation, the size of the radius is a function of the radius of the first part, in the same cross-sectional plane. The size of the radius may be the radius of the first part divided by a predetermined factor, such as a number between 1 and 10, such as between 2 and 8, such as between 3 and 6 or between 3 and 5.

The first radius may depend on the opening from the first part to the surroundings. In one embodiment, the first radius is selected as a function of the revolution angle of the first curved line. This revolution angle preferably is larger than 180°, such as larger than 190°.

in one example, the largest diameter may be 9-10 mm and the revolution angle may be 220-270°.

Thus, the second radius is smaller than the first radius and may also be at least 2 mm, such as at least 4 mm, preferably at least 5 mm, such as at least 8 mm. The second radius may be selected at any position between that of the first circle and the point P, such as in the middle there between, closer to the longitudinal position of the first circle or closer to the point P. he second radius may be 50% of the first radius, such as when a distance between the point P and the second longitudinal position is 50% of the distance between P and the first longitudinal position.

In one embodiment, the first side portion has, at the first part, a shape approximating a part of a circle, where the radius of the circle increases with increasing distance, along the axis, to the point P. This may be the above relation between longitudinal position and radius. This relation preferably is linear, but other relations may also be used. Preferably, this relation is continuous and slowly decaying toward P.

In that or another embodiment, the apparatus further comprises a second side portion extending from the first part at the second angular position and to the back surface at the fourth angular position, the second side portion, at the second angular position and at the first part, having a shape approximating:

at the first longitudinal position along the axis, a part of a circle having a third radius, and at the second longitudinal position along the axis, a part of a circle having a fourth radius, the fourth radius being smaller than the third radius.

Thus, the first and third radii may be the same, and the second and fourth radii may be the same.

Preferably, the first and second side portions are mirror images of each other so that the diameters are the same or at least substantially the same at any longitudinal position. Thus, the comments relating to the first side portion are equally applicable in this situation.

In fact, the first and second side portions may each have a general direction, in a plane perpendicular to the axis, between the first and third borders and the second and fourth borders, respectively. The first and second side portions may define a fanning-out opening from the first part toward the surroundings, when an angle, in the plane, between the general directions of the first and second side portions, is less than 180°. This angle may be defined in a number of manners and may be less than 170°, such as less than 160°. This angle takes part in the definition in the plane of the propagation of acoustic energy from the first part toward the surroundings.

In one embodiment, the apparatus further comprises a second part having a shape of a second surface of revolution, within a second angular interval and around the axis, of a second curved line extending through the point P, the first part being defined at longitudinal positions, along the axis, on one side of the point P and the second part being defined at longitudinal positions on an opposite side of the point P.

Naturally, the first and second curved lines may be formed by a single curved, continuous line on which P is positioned. This single, curved line may be defined as e.g. a part of a circle, an oval, a parabola, a hyperbola or the like.

Alternatively, the first and second curved lines may be different and may define a combined curve having a sharp edge (the derivative is non-continuous) at the point P.

The first and second angular intervals may be identical or different.

Preferably, at least 60% of the second angular interval extends diametrically opposite, around the axis, to angles within the first angular interval. In this manner, the second part extends to angles where the first part is not defined, i.e. where an opening may be defined through which acoustic energy may escape the first part toward the second part and/or the surroundings.

In one embodiment, the second part has an outer edge shaped as at least substantially a part of a circle having a centre at the axis and a radius defined by a distance between the axis and a border between the back surface and the first side portion in a plane perpendicular to the axis and comprising the outer edge.

Thus, the size/diameter of the outer edge and thereby of the second part is defined by the border between the back surface and the first side portion.

On one embodiment, the distance between the axis and the border between the back surface and the side portion, in the plane perpendicular to the axis, decreases with increasing distance to P, along the axis and on the opposite side of the point P, i.e. along the part of the axis where the second part is defined. Thus, the border between the back surface and the first side portion, and the second side portion if this is provided and the side portions are mirrored, may be desired slanting or converging such as to reduce the size of the second portion. Naturally, this slanting/converging shape may be seen also at longitudinal positions at the other side of the point P, i.e. where the first part is defined. Thus, preferably, the converging shape of the border may be a smooth, continuous curve.

A third aspect of the invention relates to an apparatus for redistributing acoustic energy, the apparatus comprising a surface with:

a first part having a shape of a first surface of revolution, within a first angular interval from a first angular position to a second angular position and around an axis, of a first line extending through a point, P, on the axis, a first border being defined by the first part at the first angular position and a second border being defined by the first part at the second angular position, a second part having a shape of a second surface of revolution, within a second angular interval from a fifth angular position to a sixth angular position and around the axis, of a second line extending through the point P, the first part being defined at longitudinal positions, along the axis, on one side of the point P and the second part being defined at longitudinal positions on an opposite side of the point P, a fifth border being defined by the second part at the fifth angular position and a sixth border being defined by the second part at the sixth angular position, a back surface extending within a third angular interval from a third angular position to a fourth angular position and around the axis, a third border being defined by the back surface at the third angular position, a fourth border being defined by the back surface at the fourth angular position, the back surface being positioned further away from the axis than the first part, a first side portion extending from the first border to the fifth border and to the third border and a second side portion extending from second border to the sixth border and to the fourth border, wherein the second part has an outer edge portion shaped as a polygon all parts of which are positioned at or within a circle having a centre at the axis and a diameter defined by a distance between second part at the fifth and sixth angular positions, respectively, in a plane perpendicular to the axis and comprising the outer edge.

wherein a distance between the axis and the third and fourth borders, respectively, in the plane perpendicular to the axis, decreases with increasing distance, along the axis, to P.

In this aspect, the first and second parts as well as the side portions may be as those described above. In the present aspect, the borders of the side portions converge so that the edge portion of the second part may be smaller.

In one embodiment, a sum of the first and third angular intervals is less than 360 degrees. Then, the side portions may have an overall, funnel-shape which aids in the defining of the sound emission in a plane perpendicular to the axis.

In one embodiment:

the first side portion has, at the first border, a shape approximating:

at a first longitudinal position along the axis, a part of a circle having a first radius, and at a second longitudinal position along the axis, a part of a circle having a second radius, the second longitudinal position being closer to the point P than the first longitudinal position and the second radius being smaller than the first radius.

and the second side portion has, at the second border, a shape approximating:

at the first longitudinal position along the axis, a part of a circle having a third radius, and at the second longitudinal position along the axis, a part of a circle having a fourth radius, the fourth radius being smaller than the third radius.

This is described in relation to the second aspect.

In a particular embodiment, the first side portion has, at the first part, a shape approximating a part of a circle, where the radius of the circle increases with increasing distance, along the axis, to the point P.

In one embodiment, at least 60% of the second angular interval extends diametrically opposite, around the axis, to angles within the first angular interval.

Preferably, the second part is symmetrical around a plane defined along the axis and dividing the first angular interval in halves.

The second part may have 2, 3, 4, 5, 6, 7, 8, 9, 10 or more sides. In one embodiment, the second part has an uneven number of sides with a central side being perpendicular to a plane defined by the axis and diving the first angular interval in halves.

A fourth aspect of the invention relates to an apparatus for redistributing acoustic energy, the apparatus comprising a surface with:

a first part having a shape of a first surface of revolution, within a first angular interval from a first angular position to a second angular position and around an axis, of a first line extending through a point, P, on the axis, a first border being defined by the first part at the first angular position and a second border being defined by the first part at the second angular position, a first side portion extending from the first border and in a direction away from the first and second borders, a second side portion extending from second border and in a direction away from the first and second borders, wherein, in a cross section perpendicular to the axis, the first part and the first and second side portions define a curve, no parts of which deviates from a circle, having a diameter exceeding a predetermined minimum diameter and being fitted to the part, by more than 10% of the diameter of the circle.

Figure 7:
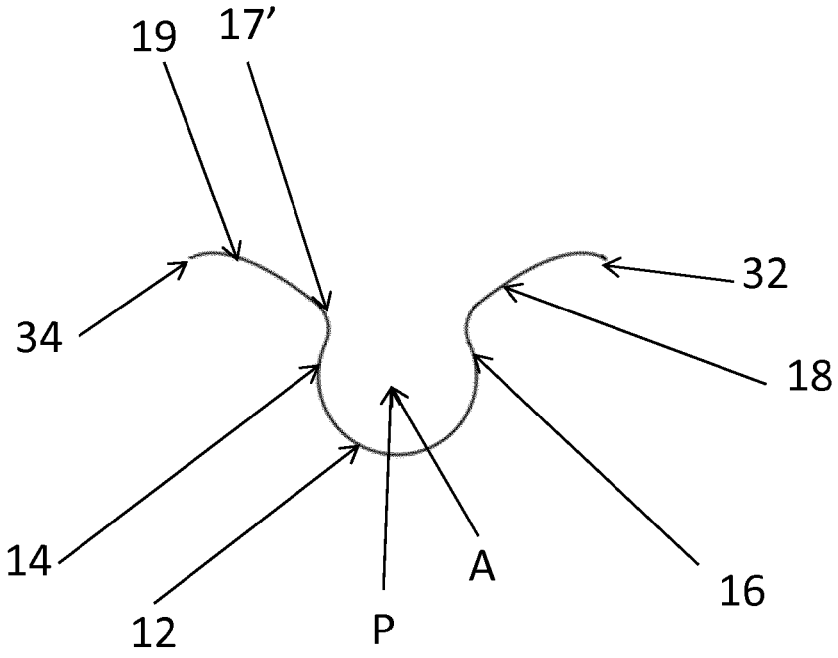

Thus, as is also described in relation to FIG. 7, the actual shapes of the second part, the side portions and in particular the back portion may not be a decisive factor.

Preferably, the part of the curve has a minimum extent, which may be related to the diameter of the fitted circle.

When fitting the curve to the part, a number of algorithms may be used for providing the best curve fit.

When the circle has a diameter exceeding the minimum diameter, which may be an absolute diameter, such as 2, 3, 4, 5, 6, 7 mm or the like. Alternatively, the minimum diameter may be determined on the basis of a longitudinal position along the axis of the cross section defining the curve.

Alternatively or additionally, the minimum diameter may be determined from the first angular interval. In one example, the minimum diameter may increase with an increase in the first angular interval.

Alternatively or additionally, separate curves may be determined in separate, different cross sections at different longitudinal positions, where the minimum diameter may be desired to increase with increasing longitudinal distance from the point P.

Naturally, this aspect may also have the second part, back part etc. of any of the other aspects.

In general, the apparatus according to the invention may further comprise a third area comprising an opening through which the first curved line, within the first angular interval, and the axis extend. This opening may be used for receiving the acoustic energy to be reproduced.

A final aspect relates to a loudspeaker comprising an apparatus according to any of the preceding aspects and a sound generator positioned so as to emit sound along the axis and onto the first area.

Preferably, the sound generator has a membrane positioned in a plane at least perpendicularly to the axis.

Naturally, the sound generator may have e.g. a suspension or other resilient material at an edge of the membrane, where the apparatus may have a slot positioned between the first part and the back surface for taking up the suspension or other resilient material in order for the first part to be able to extend to an edge of the membrane.

Figure 2:
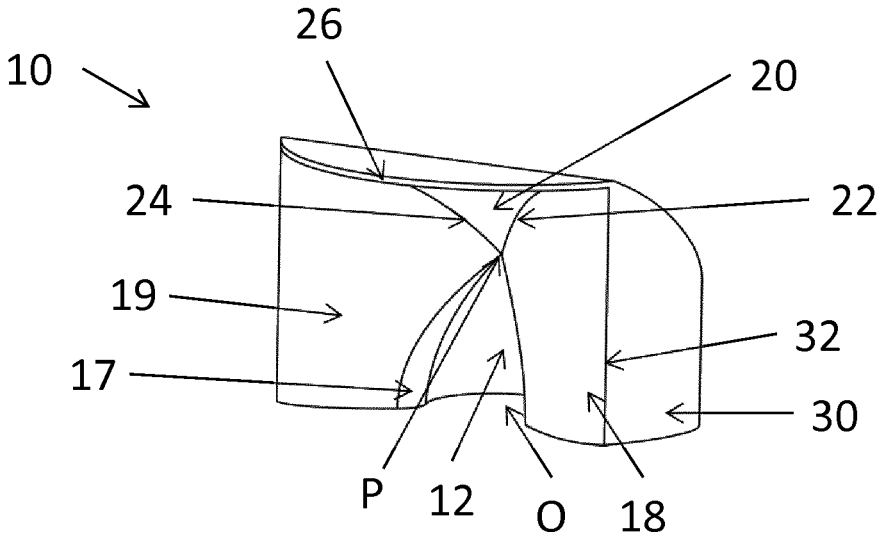
Figure 3:
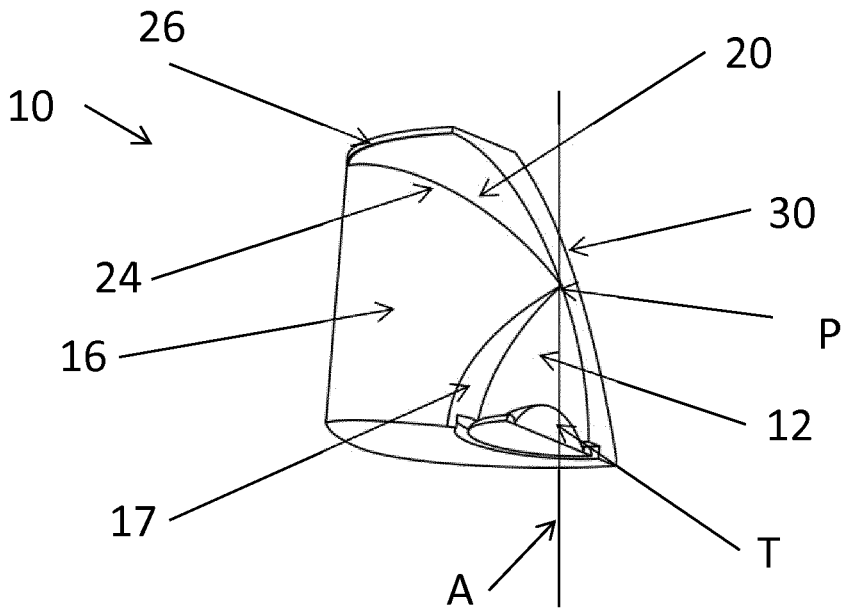
Figure 4:
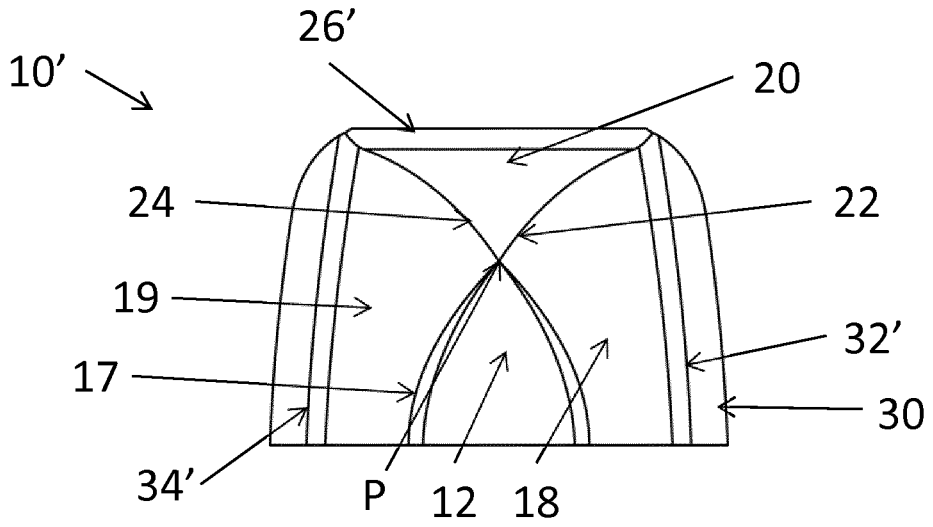
Figure 5A:
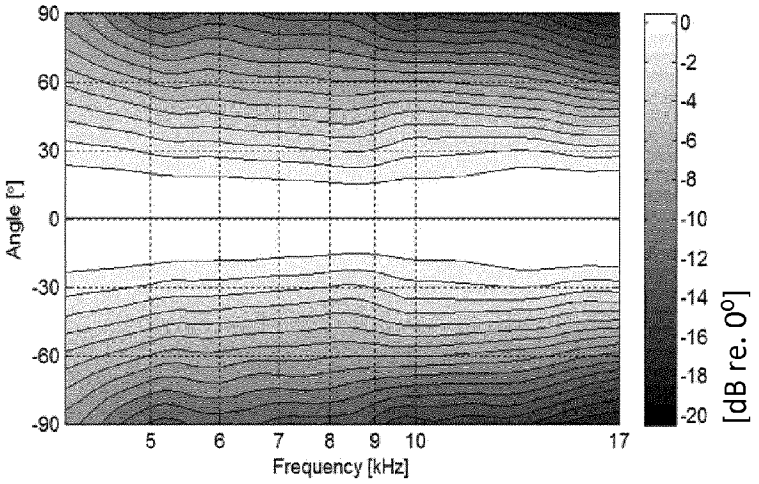
Figure 5A:
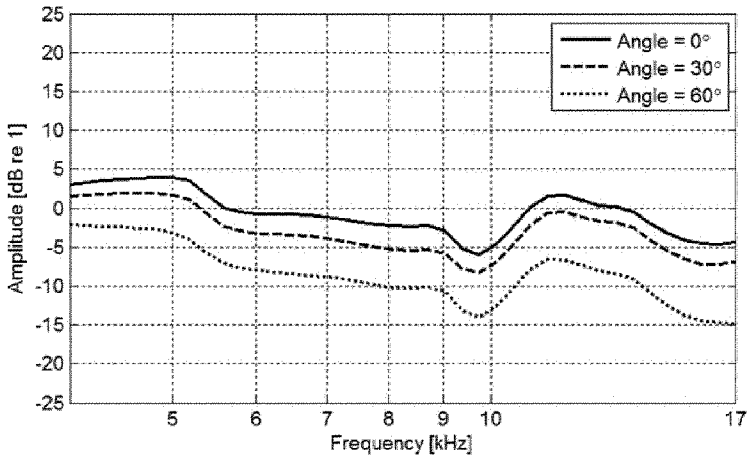
Figure 5B:
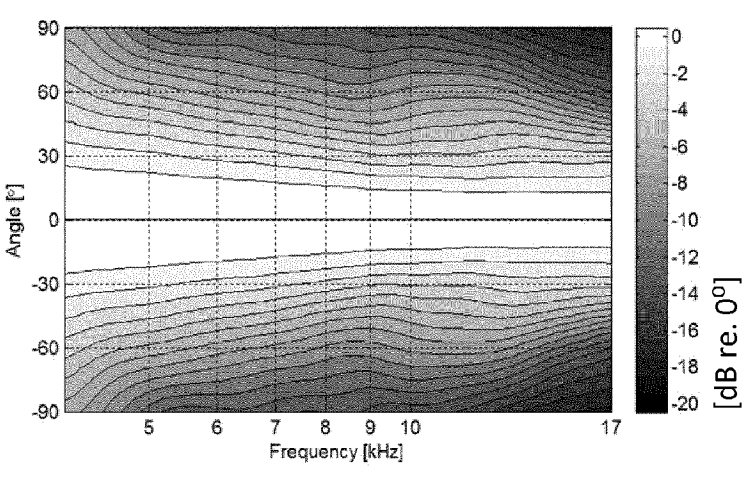
Figure 5B:
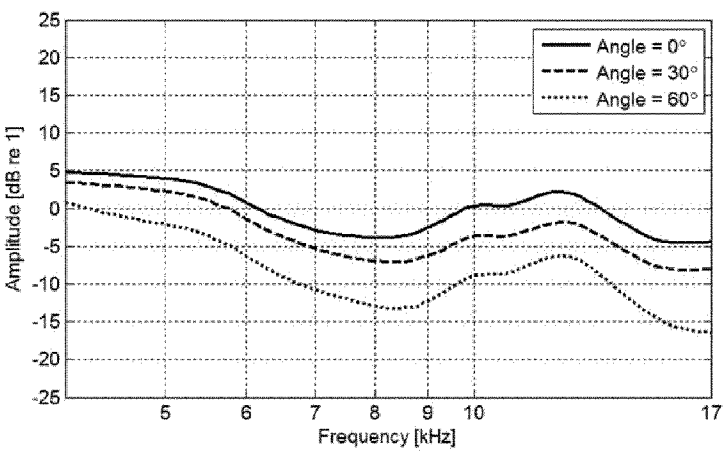
Figure 6:
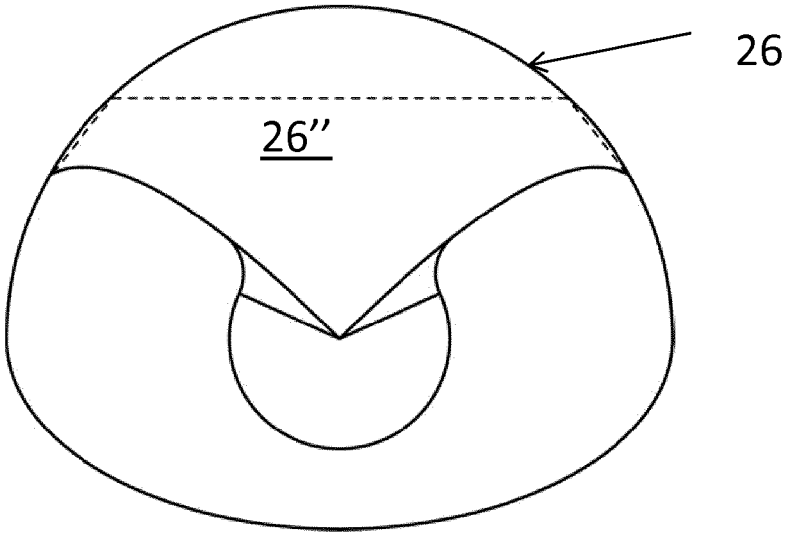

In the following, preferred embodiments of the invention will be described with reference to the drawing, wherein:

FIG. 1 illustrates a first embodiment of an apparatus according to the invention seen along the axis, FIG. 2 illustrates the first embodiment seen from the side, FIG. 3 illustrates a cross section of a loudspeaker comprising a membrane and the first embodiment of FIG. 1, FIG. 4 illustrates another embodiment of an apparatus according to the invention seen from the front, FIG. 5 illustrates horizontal directivity and absolute frequency response at selected frequencies for the apparatus of FIGS. 2 and 4, FIG. 6 illustrates a third embodiment with a differently shaped second part and FIG. 7 illustrates a cross section perpendicular to the axis A.

In FIGS. 1 and 2, a first embodiment 10 according to the invention is seen having a first part 12 shaped as a surface of revolution around an axis A directed perpendicularly out of and into the drawing at the point P. The first part 12 extends from a first border 14 to a second border 16 along the direction of rotation around the axis A. In this embodiment, the angular extent of the first part 12, in all planes perpendicular to the axis A and wherein a portion of the first part 12 exists, is the same. The borders 14 and 16 are illustrated by lines but preferably are identifiable as the transition from the surface of revolution and the side portions.

The first part 12 extends from a first angle at the border 14 to a second angle at the border 16 and thus over a first angular interval illustrated by the bent double arrow.

A back portion 30 is provided, the shape of which is not particularly important. The back portion 30 is the other side of the element or material of which the concavity forming the first part is provided. Preferably, the back surface extends, around the axis, from a third border or angle 32 to a fourth border or angle 34 substantially within a third angular interval, which preferably has a large overlap with the first angular interval. One of the first and third angular interval preferably is comprised within the other of the first and third angular intervals.

Two side portions 18 and 19 are provided between the first/second borders 14/16 and the third/fourth borders 32/34 of the back surface 30. The transition between the side portions 18/19 and the back portion 30 need not be particularly important, especially if no sound impinges on this transition.

Provided is also a second part 20 is illustrated which is also defined as a surface of revolution of the same line as that of the first part 12 or another line/curve. Also the line/curve defining the second surface 20 intersects the axis A at the point P. Along the axis, the first part 12 extends, along the axis, to one side of the point P and the second part extends to the other side of the point P.

The second part and the side portions engage or meet at the fifth/sixth borders, respectively, 22 and 24. The second part is limited, at an outermost part, by an edge 26 shaped as a part of a circle having its centre at the axis A. The diameter of this circle is defined by the distance between the axis A and the borders 32 and 34, respectively, at the same longitudinal position along the axis.

Especially in FIG. 1, the shape of the side portions is visible. This shape may be provided in order that the cavity formed by 12 does not become closed to an extent where the opening has an area smaller than the radiating area of the diaphragm of the sound source. This is especially interesting when the first angular interval of the part 12 exceeds 180 degrees, such as when it exceeds 200, 220 or 230 degrees.

Another reason is to avoid sharp edges causing negative interference in the sound. The shape is provided by the portion 17 of the side portions the closest to the first/second borders 14/16 having been rounded so as to form a smooth transition from the shape of the first part 12 and to the more radial shape of a main portion 17' of the side portions. The exact shape of this rounded portion 17 may be selected in many manners. In one embodiment, the shape is that of a part of a circle, as indicated in hatched lines, but also other shapes may be defined.

It is seen that the closer to the point P, the smaller is the diameter of the circle of the shape of the part 17.

It is desired that from the border 16/14 the shape of the part 17 of the side portion 18/19 is rounded and conforms to a circle for at least an angle of 40°, such as at least 75°, where the "conforms" means that the side portion 18/19 deviates from the circle by no more than 10%, such as no more than 5% of the length of the radius of the circle, where the deviation from a point on the side portion to the circle is determined along a radius of the circle.

Alternatively, the side portions may simply be flat and extend outwardly from the borders 14/16. In that situation, the parts 17 are not rounded but may be desired sharp. Then, the rotation angle of the first part 12 in FIG. 1 is 270 degrees. This rotation angle may be from 230-300 degrees, for example.

At the bottom of the apparatus 10, an opening O is positioned which is defined at a lower edge of the first part 12. This opening may (see FIG. 3) be used for receiving the sound or acoustic energy to be redistributed. Naturally, the opposite direction of the sound may be used, if desired, such as if using the apparatus 10 as a collector of sound for e.g. a microphone.

In FIG. 3, a cross section is seen wherein also a tweeter T is positioned in the opening O. Sound output of this tweeter T, when positioned with the diaphragm plane perpendicular to the axis and with the axis intersecting the tweeter diaphragm at its center, will be directed more or less along the axis and will impinge on the first part 12 and the second part 20 and on the part 16 and will be re-directed thereby and toward the surroundings.

In FIG. 4, a slightly different embodiment 10' is seen wherein the side borders 32' and 34' are converging both toward each other and the axis in the upward direction. This slightly alters the shape of the side portions 18/19 but primarily reduces the size of the second part 20 and the diameter of the upper edge 26', which is still defined by the distance, at that longitudinal position along the axis, between the axis and one of or both the edges 32/34.

In the embodiment of FIG. 4, compared to that in FIG. 2, a slightly narrowing horizontal directivity is obtained with increasing frequency and smoother absolute response, whereas in 10 the radiation widens slightly >10 kHz see plots 5A and 5B, and the absolute response is more even. It is noted that the double lines in FIG. 4, as at the front border 26 of the second part 20 and at the borders 32' and 34', are caused by these parts being curved.

In FIGS. 5A and 5B illustrate the horizontal directivity (when oriented as in the figures) and the absolute frequency response at selected, discrete angles, for the apparatus illustrated in FIGS. 2 and 4, respectively.

It is seen that the directionality in the horizontal plane is extremely flat and is slightly increasing with frequency. In FIG. 5A, the radiation widens slightly above 10 kHz. These plots illustrate that the frequency response at angles in the horizontal plane in front of the device is almost constant, it is only the volume level that changes—lowering at angles further to each side of the main radiation axis of the device. Thus, no lobes or ripples are seen. Also, the frequency response is smoother.

It is noted that due to the smaller size of the second part 20, the frequency response of the apparatus of FIG. 4 has less sharp bends, which makes the filtering of an acoustic signal for the loudspeaker T simpler in order to feed this loudspeaker with a signal counteracting the non-linear response of the apparatus.

In FIG. 6, an embodiment quite similar to that of FIG. 1 is seen but wherein the second part 20 has a different shape, as is illustrated in hatched lines. In this embodiment, the outer boundary 26" of the second part is that of a part of a polygon all parts of which are positioned at or within the circular outline 26 also seen in FIG. 1.

Generally, the shape of the second part 20 may be varied, but it is preferred maintained inside or at the circular outline defined by the distance from the axis A to one or both of the borders 32/34.

FIG. 7 illustrates the combined shape of the first part 12 and the side portions 18/19 in a cross section perpendicular to the axis A and at one longitudinal position along the axis.

The illustrated cross section is usually at the bottom of the apparatus and far from the point P.

As explained further above, when the rotation angle of the revolution surface of the first part 12 becomes large, such as 200° or more, a rounding of the side portions 18/19 may be desired in order to ensure a sufficient output of sound.

It is seen that the part 17' of the side portions 18/19 may conform to a circle, a parabola or a number of other shapes.

It is desired that the curve does not have sharp edges or bends. Thus, it is desired that the derivative thereof has no discontinuities. However, a sharp bend/edge may be acceptable, if its extent over e.g. a flat surface is limited.

Thus, it is desired that at least the part 17' but preferably also at least half of the curve between the border 14/16 and the border 32/34, starting from the border 14/16, is smooth and has a predetermined minimum bending angle or rate of change, such as when approximated by—or conforming to—a circle with a diameter exceeding a predetermined minimum diameter.

Preferably, the approximation is required over a predetermined minimum part of the circle, and especially if the circle diameter is close to the predetermined minimum diameter. Naturally, this part may be defined as an angle of the circle, but for large circles, this may not be the best option.

In one embodiment, it is required that for each part of the curve having a length of 1/10 or more, such as 1/8 or more, such as 1/6 or more, such as 1/4 or more of the circumference of a circle with the predetermined minimum diameter, this part must conform to a circle When the approximation allows a small deviation from the circle shape, small, localized, sharp bends/edges are accepted.

Thus, preferably the approximation means that no part of the part of the curve deviates from the circle by more than 10%, such as no more than 5% of the length of the radius of the circle, where the deviation from a point on the side portion to the circle is determined along a radius of the circle.

Usually, the diameter of the first part 12 is larger than the minimum diameter of the circle, whereby the first part 12 automatically fulfils this requirement.

The invention claimed is:

1. An apparatus for redistributing acoustic energy, the apparatus comprising a surface with:

a first part having a shape of a first surface of revolution, within a first angular interval from a first angular position to a second angular position and around an axis, of a first line extending through a point, P, on the axis;

a second part having a shape of a second surface of revolution, within a second angular interval from a fifth angular position to a sixth angular position and around the axis, of a second line extending through the point P, the first part being defined at longitudinal positions, along the axis, on one side of the point P and the second part being defined at longitudinal positions on an opposite side of the point P; and a back surface extending, within a third angular interval from a third angular position to a fourth angular position and around the axis, the back surface being positioned further away from the axis than the first part, wherein the first angular interval exceeds 230°.

2. An apparatus for redistributing acoustic energy, the apparatus comprising a surface with:

a first part having a shape of a first surface of revolution, within a first angular interval from a first angular position to a second angular position and around an axis, of a first line extending through a point, P, on the axis, a back surface extending, within a third angular interval from a third angular position to a fourth angular position and around the axis, the back surface being positioned further away from the axis than the first part, and a first side portion extending from the first part at the first angular position and to the back surface at the third angular position, the first the side portion having, at the first angular position and at the first part, a shape approximating, in a first plane perpendicular to the axis and positioned at a first longitudinal position along the axis, a part of a circle having a first radius, and in a second plane perpendicular to the axis and positioned at a second longitudinal position along the axis, a part of a circle having a second radius, the second longitudinal position being closer to the point P than the first longitudinal position and the second radius being smaller than the first radius.

3. An apparatus according to claim 2, wherein the first side portion has, at the first part, a shape approximating a part of a circle, where the radius of the circle increases with increasing distance, along the axis, to the point P.

4. An apparatus according to claim 2, further comprising a second side portion extending from the first part at the second angular position and to the back surface at the fourth angular position, the second side portion, at the second angular position and at the first part, having a shape approximating, in the first plane and at the first longitudinal position along the axis, a part of a circle having a third radius, and in the second plane and at the second longitudinal position along the axis, a part of a circle having a fourth radius, the fourth radius being smaller than the third radius.

5. An apparatus according to claim 2, further comprising a second part having a shape of a second surface of revolution, within a second angular interval and around the axis, of a second curved line extending through the point P, the first part being defined at longitudinal positions, along the axis, on one side of the point P and the second part being defined at longitudinal positions on an opposite side of the point P.

6. An apparatus according to claim 5, wherein at least 60% of the second angular interval extends diametrically opposite, around the axis, to angles within the first angular interval.

7. An apparatus according to claim 5, wherein the second part has an outer edge shaped as at least substantially a part of a circle having a centre at the axis and a radius defined by a distance between the axis and a border between the back surface and the first side portion in a plane perpendicular to the axis and comprising the outer edge.

8. An apparatus according to claim 7, wherein the distance between the axis and the border, in the plane perpendicular to the axis, decreases with increasing distance to P, along the axis and on the opposite side of the point P.

9. An apparatus for redistributing acoustic energy, the apparatus comprising a surface with:

a first part having a shape of a first surface of revolution, within a first angular interval from a first angular position to a second angular position and around an axis, of a first line extending through a point, P, on the axis, a first border being defined by the first part at the first angular position and a second border being defined by the first part at the second angular position;

a second part having a shape of a second surface of revolution, within a second angular interval from a fifth angular position to a sixth angular position and around the axis, of a second line extending through the point P, the first part being defined at longitudinal positions, along the axis, on one side of the point P and the second part being defined at longitudinal positions on an opposite side of the point P, a fifth border being defined by the second part at the fifth angular position and a sixth border being defined by the second part at the sixth angular position;

a back surface positioned, within a third angular interval from a third angular position to a fourth angular position and around the axis, a third border being defined by the back surface at the third angular position, a fourth border being defined by the back surface at the fourth angular position, the back surface being positioned further away from the axis than the first part;

a first side portion extending from the first border to the fifth border and to the third border; and a second side portion extending from second border to the sixth border and to the fourth border, wherein the second part has an outer edge portion shaped as a polygon all parts of which are positioned at or within a circle having a centre at the axis and a diameter defined by a distance between second part at the fifth and sixth angular positions, respectively, in a plane perpendicular to the axis and comprising the outer edge, wherein a distance between the axis and the third and fourth borders, respectively, in the plane perpendicular to the axis, decreases with increasing distance, along the axis, to P.

10. An apparatus according to claim 9, wherein a sum of the first and third angular intervals is less than 360 degrees.

11. An apparatus according to claim 9, wherein:

the first side portion has, at the first border, a shape approximating at a first longitudinal position along the axis, a part of a circle having a first radius, and at a second longitudinal position along the axis, a part of a circle having a second radius, the second longitudinal position being closer to the point P than the first longitudinal position and the second radius being smaller than the first radius; and the second side portion has, at the second border, a shape approximating, at the first longitudinal position along the axis, a part of a circle having a third radius, and at the second longitudinal position along the axis, a part of a circle having a fourth radius, the fourth radius being smaller than the third radius.

12. An apparatus according to claim 11, wherein the first side portion has, at the first part, a shape approximating a part of a circle, where the radius of the circle increases with increasing distance, along the axis, to the point P.

13. An apparatus according to claim 9, wherein at least 60% of the second angular interval extends diametrically opposite, around the axis, to angles within the first angular interval.

14. An apparatus for redistributing acoustic energy, the apparatus comprising a surface with:

a first part having a shape of a first surface of revolution, within a first angular interval from a first angular position to a second angular position and around an axis, of a first line extending through a point, P, on the axis, a first border being defined by the first part at the first angular position and a second border being defined by the first part at the second angular position;

a first side portion extending from the first border and in a direction away from the first and second borders; and a second side portion extending from second border and in a direction away from the first and second borders, wherein, in a cross section perpendicular to the axis, the first part and the first and second side portions define a curve, no parts of which deviates from a circle, having a diameter exceeding a predetermined minimum diameter and being fitted to the part, by more than 10% of the diameter of the circle.

15. An apparatus according to claim 1, further comprising a third area comprising an opening through which a first curved line, within the first angular interval, and the axis extend.

16. A loudspeaker comprising an apparatus according to claim 1 and a sound generator positioned so as to emit sound along the axis and onto a first area.

17. An apparatus according to claim 1, wherein the first angular interval is 240-270°.

18. An apparatus according to claim 1, wherein the first angular interval is 260-280°.

* * * * *